US009903537B2

(12) United States Patent
Jiang

(10) Patent No.: US 9,903,537 B2
(45) Date of Patent: Feb. 27, 2018

(54) LED TUBE LAMP

(71) Applicant: JIAXING SUPER LIGHTING ELECTRIC APPLIANCE CO., LTD, Zhejiang (CN)

(72) Inventor: Tao Jiang, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 177 days.

(21) Appl. No.: 15/056,106

(22) Filed: Feb. 29, 2016

(65) Prior Publication Data

US 2016/0178137 A1 Jun. 23, 2016

Related U.S. Application Data

(63) Continuation-in-part of application No. PCT/CN2015/096502, filed on Dec. 5, 2015.

(30) Foreign Application Priority Data

Dec. 5, 2014 (CN) ..... 2014 1 0734425
Feb. 12, 2015 (CN) ..... 2015 1 0075925
(Continued)

(51) Int. Cl.
*F21V 23/02* (2006.01)
*F21K 99/00* (2016.01)
(Continued)

(52) U.S. Cl.
CPC ..... *F21K 9/175* (2013.01); *F21K 9/27* (2016.08); *F21V 3/0418* (2013.01);
(Continued)

(58) Field of Classification Search
CPC .... F21V 19/00; F21V 19/0005; F21V 19/001; F21V 23/023; F21V 25/04; F21V 31/005;
(Continued)

(56) References Cited

U.S. PATENT DOCUMENTS 2,454,049 A 11/1948 Floyd, Jr.
3,294,518 A 12/1966 Laseck et al.
(Continued)

FOREIGN PATENT DOCUMENTS

CN 201014273 Y 1/2008
CN 201363601 12/2009
(Continued)

*Primary Examiner* — Ali Alavi
(74) *Attorney, Agent, or Firm* — Andrew M. Calderon; Roberts Mlotkowski Safran Cole & Caleron, P.C.

(57) ABSTRACT

An LED tube lamp including a glass lamp tube, an end cap disposed at one end of the glass lamp tube, a power supply provided inside the end cap, an LED light strip disposed inside the glass lamp tube with a plurality of LED light sources mounted on. At least a part of an inner surface of the glass lamp tube is formed with a rough surface, and the glass lamp tube is covered by a heat shrink sleeve. The LED light strip has a bendable circuit sheet which is made of a metal layer structure to electrically connect the LED light sources with the power supply. The glass lamp tube and the end cap are secured by a highly thermal conductive silicone gel with its thermal conductivity not less than 0.7 w/m·k.

20 Claims, 6 Drawing Sheets

(30) Foreign Application Priority Data

| | | |
|---|---|---|
| Mar. 27, 2015 | (CN) | 2015 1 0136796 |
| May 19, 2015 | (CN) | 2015 1 0259151 |
| Jun. 12, 2015 | (CN) | 2015 1 0324394 |
| Jun. 17, 2015 | (CN) | 2015 1 0338027 |
| Jun. 26, 2015 | (CN) | 2015 1 0373492 |
| Jul. 27, 2015 | (CN) | 2015 1 0448220 |
| Aug. 7, 2015 | (CN) | 2015 1 0482944 |
| Aug. 8, 2015 | (CN) | 2015 1 0483475 |
| Aug. 14, 2015 | (CN) | 2015 1 0499512 |
| Sep. 2, 2015 | (CN) | 2015 1 0555543 |
| Sep. 6, 2015 | (CN) | 2015 1 0557717 |
| Sep. 18, 2015 | (CN) | 2015 1 0595173 |
| Oct. 8, 2015 | (CN) | 2015 1 0645134 |
| Oct. 29, 2015 | (CN) | 2015 1 0716899 |
| Oct. 30, 2015 | (CN) | 2015 1 0726365 |
| Dec. 2, 2015 | (CN) | 2015 1 0868263 |

(51) Int. Cl.

| | |
|---|---|
| ***F21V 3/04*** | (2018.01) |
| ***F21V 25/04*** | (2006.01) |
| ***F21V 7/00*** | (2006.01) |
| ***F21V 29/83*** | (2015.01) |
| ***F21V 15/015*** | (2006.01) |
| ***F21V 17/10*** | (2006.01) |
| ***F21V 19/00*** | (2006.01) |
| ***F21K 9/27*** | (2016.01) |
| *F21Y 103/10* | (2016.01) |
| *F21Y 115/10* | (2016.01) |

(52) U.S. Cl.

CPC ..... *F21V 3/0472* (2013.01); *F21V 7/005* (2013.01); *F21V 15/015* (2013.01); *F21V 17/101* (2013.01); *F21V 19/009* (2013.01); *F21V 23/02* (2013.01); *F21V 23/023* (2013.01); *F21V 25/04* (2013.01); *F21V 29/83* (2015.01); *F21Y 2103/10* (2016.08); *F21Y 2115/10* (2016.08)

(58) Field of Classification Search

CPC ..... F21V 3/0418; F21V 3/0427; F21V 7/005; F21Y 2103/10; F21Y 2115/10; F21K 9/27; F21K 9/272; F21K 9/275; F21K 9/278

See application file for complete search history.

(56) References Cited

U.S. PATENT DOCUMENTS

| | | | |
|---|---|---|---|
| 4,156,265 | A | 5/1979 | Rose |
| 4,647,399 | A | 3/1987 | Peters et al. |
| 5,575,459 | A | 11/1996 | Anderson |
| 5,921,660 | A | 7/1999 | Yu |
| 6,118,072 | A | 9/2000 | Scott |
| 6,127,783 | A | 10/2000 | Pashley et al. |
| 6,186,649 | B1 | 2/2001 | Zou et al. |
| 6,211,262 | B1 | 4/2001 | Mejiritski et al. |
| 6,609,813 | B1 | 8/2003 | Showers et al. |
| 6,796,680 | B1 | 9/2004 | Showers et al. |
| 6,860,628 | B2 | 3/2005 | Robertson et al. |
| 6,936,855 | B1 | 8/2005 | Harrah et al. |
| 7,033,239 | B2 | 4/2006 | Cunkelman et al. |
| 7,067,032 | B1 | 6/2006 | Bremont et al. |
| 7,594,738 | B1 | 9/2009 | Lin et al. |
| 8,360,599 | B2 | 1/2013 | Ivey et al. |
| 8,456,075 | B2 | 6/2013 | Axelsson |
| 8,579,463 | B2 | 11/2013 | Clough |
| D761,216 | S | 7/2016 | Jiang |
| 9,447,929 | B2 | 9/2016 | Jiang |
| D768,891 | S | 10/2016 | Jiang et al. |
| 2002/0044456 | A1 | 4/2002 | Balestriero et al. |
| 2003/0189829 | A1 | 10/2003 | Shimizu et al. |
| 2003/0231485 | A1 | 12/2003 | Chien |
| 2004/0095078 | A1 | 5/2004 | Leong |
| 2004/0189218 | A1 | 9/2004 | Leong et al. |
| 2005/0128751 | A1 | 6/2005 | Roberge et al. |
| 2005/0162850 | A1 | 7/2005 | Luk et al. |
| 2005/0168123 | A1 | 8/2005 | Taniwa |
| 2005/0185396 | A1 | 8/2005 | Kutler |
| 2005/0207166 | A1 | 9/2005 | Kan et al. |
| 2005/0213321 | A1 | 9/2005 | Lin |
| 2006/0028837 | A1 | 2/2006 | Mrakovich et al. |
| 2007/0001709 | A1 | 1/2007 | Shen |
| 2007/0145915 | A1 | 6/2007 | Roberge et al. |
| 2007/0210687 | A1 | 9/2007 | Axelsson |
| 2007/0274084 | A1 | 11/2007 | Kan et al. |
| 2008/0030981 | A1 | 2/2008 | Mrakovich et al. |
| 2008/0192476 | A1 | 8/2008 | Hiratsuka |
| 2008/0278941 | A1 | 11/2008 | Logan et al. |
| 2008/0290814 | A1 | 11/2008 | Leong et al. |
| 2009/0140271 | A1 | 6/2009 | Sah |
| 2009/0159919 | A1 | 6/2009 | Simon et al. |
| 2009/0161359 | A1 | 6/2009 | Siemiet et al. |
| 2010/0085772 | A1 | 4/2010 | Song et al. |
| 2010/0177532 | A1 | 7/2010 | Simon et al. |
| 2010/0201269 | A1 | 8/2010 | Tzou et al. |
| 2010/0220469 | A1 | 9/2010 | Ivey et al. |
| 2010/0253226 | A1 | 10/2010 | Oki |
| 2010/0277918 | A1 | 11/2010 | Chen et al. |
| 2011/0038146 | A1 | 2/2011 | Chen |
| 2011/0057572 | A1 | 3/2011 | Kit et al. |
| 2011/0084608 | A1 | 4/2011 | Lin et al. |
| 2011/0090684 | A1 | 4/2011 | Logan et al. |
| 2011/0216538 | A1 | 9/2011 | Logan et al. |
| 2011/0279063 | A1 | 11/2011 | Wang et al. |
| 2012/0049684 | A1 | 3/2012 | Bodenstein et al. |
| 2012/0069556 | A1 | 3/2012 | Bertram et al. |
| 2012/0106157 | A1 | 5/2012 | Simon et al. |
| 2012/0146503 | A1 | 6/2012 | Negley et al. |
| 2012/0153873 | A1 | 6/2012 | Hayashi et al. |
| 2012/0169968 | A1 | 7/2012 | Ishimori et al. |
| 2012/0212951 | A1 | 8/2012 | Lai et al. |
| 2012/0293991 | A1 | 11/2012 | Lin |
| 2012/0319150 | A1 | 12/2012 | Shimomura et al. |
| 2013/0021809 | A1 | 1/2013 | Dellian et al. |
| 2013/0033881 | A1 | 2/2013 | Terazawa et al. |
| 2013/0033888 | A1 | 2/2013 | Wel et al. |
| 2013/0050998 | A1 | 2/2013 | Chu et al. |
| 2013/0069538 | A1 | 3/2013 | So |
| 2013/0094200 | A1 | 4/2013 | Dellian et al. |
| 2013/0135852 | A1 | 5/2013 | Chan et al. |
| 2013/0170196 | A1 | 7/2013 | Huang et al. |
| 2013/0170245 | A1 | 7/2013 | Hong et al. |
| 2013/0182425 | A1 | 7/2013 | Seki et al. |
| 2013/0250565 | A1 | 9/2013 | Chiang et al. |
| 2013/0256704 | A1 | 10/2013 | Hsiao et al. |
| 2013/0258650 | A1 | 10/2013 | Sharrah |
| 2013/0293098 | A1 | 11/2013 | Li et al. |
| 2014/0071667 | A1 | 3/2014 | Hayashi et al. |
| 2014/0153231 | A1 | 6/2014 | Bittmann |
| 2014/0225519 | A1 | 8/2014 | Yu et al. |
| 2014/0226320 | A1 | 8/2014 | Halliwell et al. |
| 2015/0003053 | A1* | 1/2015 | Ariyoshi ..... F21V 23/0471 362/223 |
| 2015/0009688 | A1 | 1/2015 | Timmermans et al. |
| 2015/0070885 | A1* | 3/2015 | Petro ..... F21V 3/02 362/223 |
| 2015/0176770 | A1 | 6/2015 | Wilcox et al. |
| 2015/0327368 | A1 | 11/2015 | Su et al. |
| 2016/0091147 | A1 | 3/2016 | Jiang et al. |
| 2016/0091156 | A1 | 3/2016 | Li et al. |
| 2016/0091179 | A1* | 3/2016 | Jiang ..... F21V 19/009 362/218 |
| 2016/0102813 | A1 | 4/2016 | Ye et al. |
| 2016/0178135 | A1 | 6/2016 | Xu et al. |
| 2016/0178137 | A1 | 6/2016 | Jiang |
| 2016/0178138 | A1 | 6/2016 | Jiang |
| 2016/0198535 | A1 | 7/2016 | Ye et al. |

(56) References Cited

U.S. PATENT DOCUMENTS

| | | | | |
|---|---|---|---|---|
| 2016/0212809 | A1 | 7/2016 | Xiong et al. | |
| 2016/0215936 | A1* | 7/2016 | Jiang | F21V 29/83 |
| 2016/0215937 | A1 | 7/2016 | Jiang | |
| 2016/0219658 | A1 | 7/2016 | Xiong et al. | |
| 2016/0219666 | A1 | 7/2016 | Xiong et al. | |
| 2016/0219672 | A1 | 7/2016 | Liu | |
| 2016/0223180 | A1 | 8/2016 | Jiang | |
| 2016/0223182 | A1 | 8/2016 | Jiang | |
| 2016/0229621 | A1 | 8/2016 | Jiang | |
| 2016/0255694 | A1 | 9/2016 | Jiang et al. | |
| 2016/0255699 | A1 | 9/2016 | Ye et al. | |
| 2016/0270163 | A1 | 9/2016 | Hu et al. | |
| 2016/0270164 | A1 | 9/2016 | Xiong et al. | |
| 2016/0270165 | A1 | 9/2016 | Xiong et al. | |
| 2016/0270166 | A1 | 9/2016 | Xiong et al. | |
| 2016/0270173 | A1 | 9/2016 | Xiong | |
| 2016/0270184 | A1 | 9/2016 | Xiong et al. | |
| 2016/0290566 | A1 | 10/2016 | Jiang et al. | |
| 2016/0290567 | A1 | 10/2016 | Jiang et al. | |
| 2016/0290568 | A1 | 10/2016 | Jiang et al. | |
| 2016/0290569 | A1 | 10/2016 | Jiang et al. | |
| 2016/0290570 | A1 | 10/2016 | Jiang et al. | |
| 2016/0290598 | A1 | 10/2016 | Jiang | |
| 2016/0290609 | A1 | 10/2016 | Jiang et al. | |
| 2016/0295706 | A1 | 10/2016 | Jiang | |
| 2016/0341414 | A1 | 11/2016 | Jiang | |
| 2017/0038012 | A1 | 2/2017 | Jiang | |
| 2017/0038013 | A1 | 2/2017 | Liu et al. | |
| 2017/0038014 | A1 | 2/2017 | Jiang | |
| 2017/0089521 | A1* | 3/2017 | Jiang | F21K 9/278 |
| 2017/0089530 | A1 | 3/2017 | Jiang | |
| 2017/0130911 | A1 | 5/2017 | Li et al. | |
| 2017/0159894 | A1 | 6/2017 | Jiang | |
| 2017/0167664 | A1 | 6/2017 | Li et al. | |
| 2017/0211753 | A1 | 7/2017 | Jiang et al. | |
| 2017/0219169 | A1 | 8/2017 | Jiang | |
| 2017/0227173 | A1* | 8/2017 | May | F21K 9/272 |

FOREIGN PATENT DOCUMENTS

| | | |
|---|---|---|
| CN | 201437921 | 4/2010 |
| CN | 102052652 | 5/2011 |
| CN | 102116460 | 7/2011 |
| CN | 102121578 | 7/2011 |
| CN | 202125774 | 1/2012 |
| CN | 202216003 | 5/2012 |
| CN | 102518972 | 6/2012 |
| CN | 202302841 | 7/2012 |
| CN | 102720901 | 10/2012 |
| CN | 102777788 | 11/2012 |
| CN | 102889446 | 1/2013 |
| CN | 202791824 U | 3/2013 |
| CN | 203068187 | 7/2013 |
| CN | 203240337 | 10/2013 |
| CN | 203240337 U | 10/2013 |
| CN | 203363984 | 12/2013 |
| CN | 203384716 U | 1/2014 |
| CN | 203413396 U | 1/2014 |
| CN | 203453866 U | 2/2014 |
| CN | 203464014 | 3/2014 |
| CN | 103742875 | 4/2014 |
| CN | 203549435 | 4/2014 |
| CN | 203585876 U | 5/2014 |
| CN | 203615157 | 5/2014 |
| CN | 103851547 | 6/2014 |
| CN | 203771102 | 8/2014 |
| CN | 203797382 | 8/2014 |
| CN | 104033772 | 9/2014 |
| CN | 203927469 | 11/2014 |
| CN | 203963553 U | 11/2014 |
| CN | 204042527 | 12/2014 |
| CN | 204201535 U | 3/2015 |
| CN | 204268162 | 4/2015 |
| CN | 204300737 | 4/2015 |
| CN | 104595765 | 5/2015 |
| CN | 204420636 | 6/2015 |
| CN | 104776332 | 7/2015 |
| CN | 104832813 A | 8/2015 |
| CN | 204573639 | 8/2015 |
| EP | 3146803 | 3/2017 |
| GB | 2519258 | 4/2015 |
| GB | 2523275 | 8/2015 |
| GB | 2531425 | 4/2016 |
| JP | 2008117666 | 5/2008 |
| JP | 2011061056 | 3/2011 |
| JP | 2014154479 | 8/2014 |
| KR | 20120000551 | 1/2012 |
| KR | 20120055349 | 5/2012 |
| WO | 2011132120 | 10/2011 |
| WO | 2012129301 | 9/2012 |
| WO | 2013125803 | 8/2013 |
| WO | 2014001475 | 1/2014 |
| WO | 2014117435 | 8/2014 |
| WO | 2014118754 | 8/2014 |
| WO | 2015036478 | 3/2015 |
| WO | 2015081809 | 6/2015 |
| WO | 2016086901 | 6/2016 |

* cited by examiner

LED TUBE LAMP

CROSS-REFERENCE TO RELATED APPLICATIONS

This application is a continuation-in-part application claiming benefit of PCT Application No. PCT/CN 2015/096502, filed on Dec. 5, 2015, which claims priority to Chinese Patent Applications No. CN 201410734425.5 filed on Dec. 5, 2014; CN 201510075925.7 filed on Feb. 12, 2015; CN 201510136796.8 filed on Mar. 27, 2015; CN 201510259151.3 filed on May 19, 2015; CN 201510324394.0 filed on Jun. 12, 2015; CN 201510338027.6 filed on Jun. 17, 2015; CN 201510373492.3 filed on Jun. 26, 2015; CN 201510448220.5 filed on Jul. 27, 2015; CN 201510482944.1 filed on Aug. 7, 2015; CN 201510483475.5 filed on Aug. 8, 2015; CN 201510499512.1 filed on Aug. 14, 2015; CN 201510555543.4 filed on Sep. 2, 2015; CN 201510645134.3 filed on Oct. 8, 2015; CN 201510716899.1 filed on Oct. 29, 2015, and CN 201510868263.9 filed on Dec. 2, 2015, the disclosures of which are incorporated herein in their entirety by reference.

FIELD OF THE INVENTION

The present disclosure relates to illumination devices, and more particularly to an LED tube lamp and its components including the light sources, electronic components, and end caps.

BACKGROUND OF THE INVENTION

LED lighting technology is rapidly developing to replace traditional incandescent and fluorescent lightings. LED tube lamps are mercury-free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

Typical LED tube lamps have a lamp tube, a circuit board disposed inside the lamp tube with light sources being mounted on the circuit board, and end caps accompanying a power supply provided at two ends of the lamp tube with the electricity from the power supply transmitting to the light sources through the circuit board. However, existing LED tube lamps have certain drawbacks.

First, the typical circuit board is rigid and allows the entire lamp tube to maintain a straight tube configuration when the lamp tube is partially ruptured or broken, and this gives the user a false impression that the LED tube lamp remains usable and is likely to cause the user to be electrically shocked upon handling or installation of the LED tube lamp.

Second, the rigid circuit board is typically electrically connected with the end caps by way of wire bonding, in which the wires may be easily damaged and even broken due to any move during manufacturing, transportation, and usage of the LED tube lamp and therefore may disable the LED tube lamp.

Third, grainy visual appearances are also often found in the aforementioned typical LED tube lamp. The LED chips spatially arranged on the circuit board inside the lamp tube are considered as spot light sources, and the lights emitted from these LED chips generally do not contribute uniform illuminance for the LED tube lamp without proper optical manipulation. As a result, the entire tube lamp would exhibit a grainy or non-uniform illumination effect to a viewer of the LED tube lamp, thereby negatively affecting the visual comfort and even narrowing the viewing angles of the lights. As a result, the quality and aesthetics requirements of average consumers would not be satisfied. To address this issue, the Chinese patent application with application no. CN 201320748271.6 discloses a diffusion tube is disposed inside a glass lamp tube to avoid grainy visual effects.

However, the disposition of the diffusion tube incurs an interface on the light transmission path to increase the likelihood of total reflection and therefore decrease the light outputting efficiency. In addition, the optical rotatory absorption of the diffusion tube decreases the light outputting efficiency.

In addition, the LED tube lamp may be supplied with electrical power from two end caps respectively disposed at two ends of the glass lamp tube of the LED tube lamp and a user may be electrically shocked when he installs the LED tube lamp to a lamp holder and touches the metal parts or the electrically conductive parts which are still exposed.

Accordingly, the prevent disclosure and its embodiments are herein provided.

SUMMARY OF THE INVENTION

It's specially noted that the present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and are described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED tube lamp or a portion thereof.

The present invention provides a novel LED tube lamp, and aspects thereof.

The present invention provides an LED tube lamp. According to one embodiment, the LED lamp includes a glass lamp tube, an end cap, a power supply, and an LED light strip. The glass lamp tube is covered by a heat shrink sleeve. A thickness of the heat shrink sleeve is between 20 μm and 200 μm. At least a part of an inner surface of the glass lamp tube is formed with a rough surface and the roughness of the inner surface is higher than that of an outer surface of the glass lamp tube. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet which is made of a metal layer structure and mounted on the inner surface of the glass lamp tube to electrically connect the LED light sources with the power supply. The length of the bendable circuit sheet is larger than the length of the glass lamp tube. The glass lamp tube and the end cap are secured by a highly thermal conductive silicone gel.

In some embodiments, the thermal conductivity of the highly thermal conductive silicone gel may be not less than 0.7 w/m·k.

In some embodiments, the thickness of the metal layer structure may range from 10 μm to 50 μm.

In some embodiments, the metal layer structure may be a patterned wiring layer.

In some embodiments, the roughness of the inner surface may range from 0.1 to 40 μm.

In some embodiments, the glass lamp tube may be coated with an anti-reflection layer with a thickness of one quarter of the wavelength range of light coming from the LED light source.

In some embodiments, the refractive index of the anti-reflection layer may be a square root of the refractive index of the glass lamp tube with a tolerance of ±20%.

In some embodiments, the bendable circuit sheet may have its ends extending beyond two ends of the glass lamp tube to respectively form two freely extending end portions.

In some embodiments, the LED tube lamp further may include one or more reflective films to reflect light from the plurality of LED light sources.

In some embodiments, the glass lamp tube may further include a diffusion film so that the light emitted from the plurality of LED light sources is transmitted through the diffusion film and the glass lamp tube.

In some embodiments, the glass lamp tube may be covered with an adhesive film.

The present invention also provides an LED tube lamp, according to one embodiment, includes a glass lamp tube, an end cap, a power supply, and an LED light strip. At least a part of an inner surface of the glass lamp tube is formed with a rough surface and a roughness of the inner surface is higher than that of the outer surface. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet mounted on an inner surface of the glass lamp tube to electrically connect the LED light sources with the power supply. The length of the bendable circuit sheet is larger than the length of the glass lamp tube. The glass lamp tube and the end cap are secured by a highly thermal conductive silicone gel.

The present invention also provides an LED tube lamp, according to one embodiment, includes a glass lamp tube, an end cap, a power supply, and an LED light strip. The glass lamp tube is covered by a heat shrink sleeve. The inner surface of the glass lamp tube is formed with a rough surface, the roughness of the inner surface is higher than that of the outer surface, and the roughness of the inner surface ranges from 0.1 to 40 μm. The end cap is disposed at one end of the glass lamp tube. The power supply is provided inside the end cap. The LED light strip is disposed inside the glass lamp tube with a plurality of LED light sources mounted on the LED light strip. The LED light strip has a bendable circuit sheet which is made of a metal layer structure and mounted on an inner surface of the glass lamp tube to electrically connect the LED light sources with the power supply. The length of the bendable circuit sheet is larger than the length of the glass lamp tube. The glass lamp tube and the end cap are secured by a highly thermal conductive silicone gel.

The rough surface and the roughness of the inner surface of the glass lamp tube can make the light from the LED light sources be uniform when transmitting through the glass lamp tube.

The heat shrink sleeve is capable of making the glass lamp tube electrically insulated. The heat shrink sleeve may be substantially transparent with respect to the wavelength of light from the LED light sources, such that only a slight part of the lights transmitting through the glass lamp tube is absorbed by the heat shrink sleeve. If the thickness of the heat shrink sleeve is between 20 μm to 200 μm, the light absorbed by the heat shrink sleeve is negligible.

The highly thermal conductive silicone gel has excellent weatherability and can prevent moisture from entering inside of the glass lamp tube, which improves the durability and reliability of the LED tube lamp.

The anti-reflection layer is capable of reducing the reflection occurring at an interface between the glass lamp tube's inner surface and the air, which allows more light from the LED light sources transmit through the glass lamp tube.

DETAILED DESCRIPTION OF PREFERRED EMBODIMENTS

The present disclosure provides a novel LED tube lamp based on the glass made lamp tube to solve the abovementioned problems. The present disclosure will now be described in the following embodiments with reference to the drawings. The following descriptions of various embodiments of this invention are presented herein for purpose of illustration and giving examples only. It is not intended to be exhaustive or to be limited to the precise form disclosed. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

"Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0% to 5% deviation around 0.1 and a 0% to 5% deviation around 1, especially if such deviation maintains the same effect as the listed range."

"Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein."

Figure 1A:
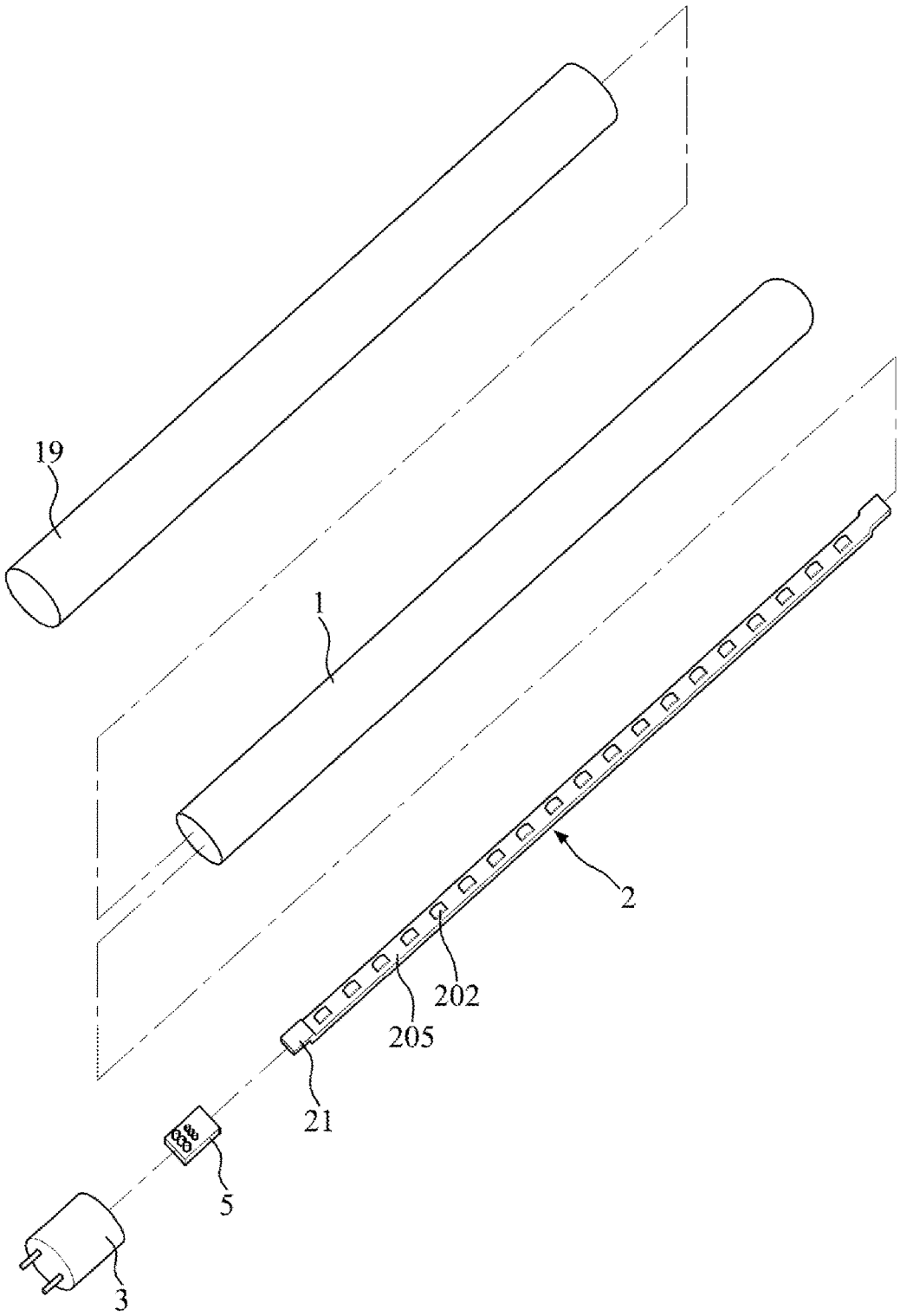
FIG. 1A is an exploded view schematically illustrating the LED tube lamp according to one embodiment of the present invention, wherein the glass lamp tube has only one inlets located at its one end while the other end is entirely sealed or integrally formed with tube body.
Figure 1B:
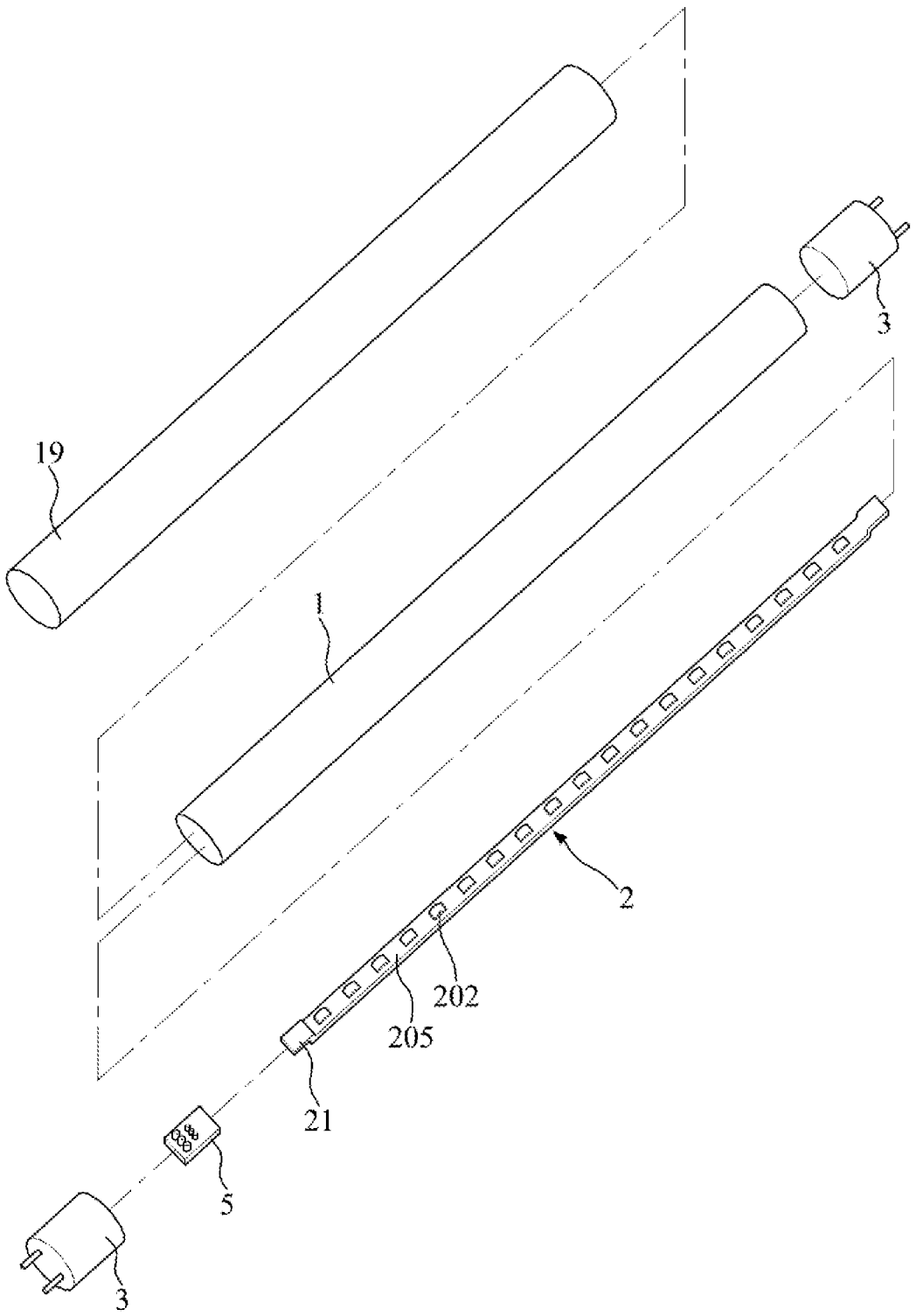
FIG. 1B is an exploded view schematically illustrating the LED tube lamp according to one embodiment of the present invention, wherein the glass lamp tube has two inlets respectively located at its two ends.
Figure 1C:
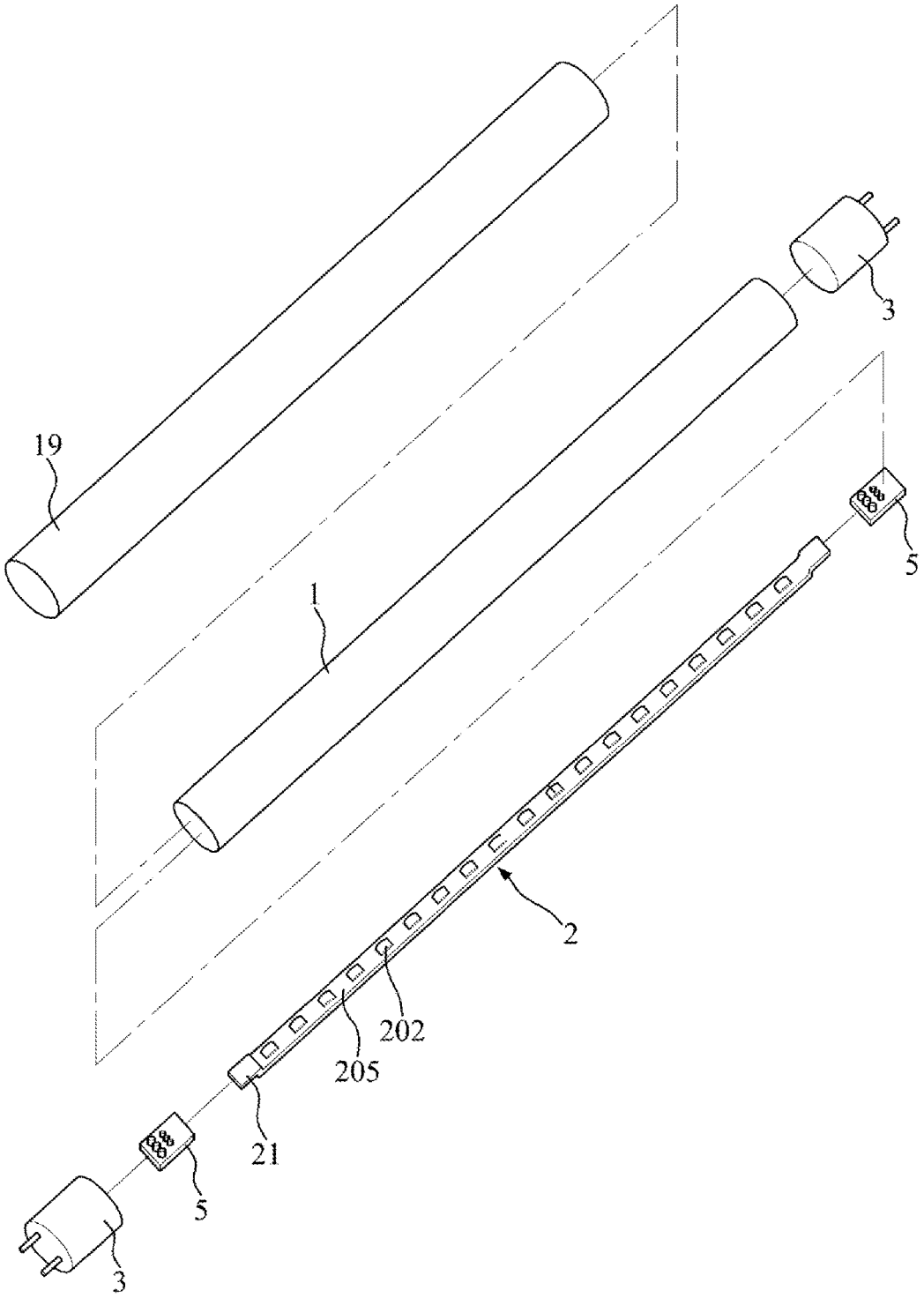
FIG. 1C is an exploded view schematically illustrating the LED tube lamp according to one embodiment of the present invention, wherein the glass lamp tube has two inlets respectively located at its two ends, and two power supplies are respectively disposed in two end caps.

Referring to FIG. 1A ,FIG. 1B, and FIG. 1C, an LED tube lamp in accordance with a first embodiment of the present invention includes a glass lamp tube 1, an LED light strip 2 disposed inside the glass lamp tube 1, and one end cap 3 disposed at one end of the glass lamp tube 1. In this embodiment, as shown in FIG. 1A, the glass lamp tube 1 may have only one inlet located at one end while the other end is entirely sealed or integrally formed with tube body. The LED light strip 2 is disposed inside the glass lamp tube 1 with a plurality of LED light sources 202 mounted on the LED light strip 2. The end cap 3 is disposed at the end of the glass lamp tube 1 where the inlet located, and the power supply 5 is provided inside the end cap 3. In another embodiment, as shown in FIG. 1B, the glass lamp tube 1 may have two inlets, two end caps 3 respectively disposed at two ends of the glass lamp tube 1, and one power supply 5 provided inside one of the end caps 3. In another embodiment, as shown in FIG. 1C, the glass lamp tube 1 may have two inlets, two end caps 3 respectively disposed at two ends of the glass lamp tube 1, and two power supplies 5 respectively provided inside the two end caps 3.

The glass lamp tube 1 is covered by a heat shrink sleeve 19. The thickness of the heat shrink sleeve 19 may range from 20 μm to 200 μm. The heat shrink sleeve 19 is substantially transparent with respect to the wavelength of light from the LED light sources 202 such that only a slight part of the lights transmitting through the glass lamp tube is absorbed by the heat shrink sleeve 19. The heat shrink sleeve 19 may be made of PFA (perfluoroalkoxy) or PTFE (poly tetra fluoro ethylene). Since the thickness of the heat shrink sleeve 19 is only 20 μm to 200 μm, the light absorbed by the heat shrink sleeve 19 is negligible. At least a part of the inner surface of the glass lamp tube 1 is formed with a rough surface and the roughness of the inner surface is higher than that of the outer surface, such that the light from the LED light sources 202 can be uniformly spread when transmitting through the glass lamp tube 1. In some embodiments, the roughness of the inner surface of the glass lamp tube 1 may range from 0.1 μm to 40 μm.

The glass lamp tube 1 and the end cap 3 are secured by a highly thermal conductive silicone gel disposed between an inner surface of the end cap 3 and outer surfaces of the glass lamp tube 1. In some embodiments, the highly thermal conductive silicone gel has a thermal conductivity not less than 0.7 w/m·k. In some embodiments, the thermal conductivity of the highly thermal conductive silicone gel is not less than 2 w/m·k. In some embodiments, the highly thermal conducive silicone gel is of high viscosity, and the end cap 3 and the end of the glass lamp tube 1 could be secured by using the highly thermal conductive silicone gel and therefore qualified in a torque test of 1.5 to 5 newton-meters (Nt-m) and/or in a bending test of 5 to 10 newton-meters (Nt-m). The highly thermal conductive silicone gel has excellent weatherability and can prevent moisture from entering inside of the glass lamp tube 1, which improves the durability and reliability of the LED tube lamp.

Figure 2:
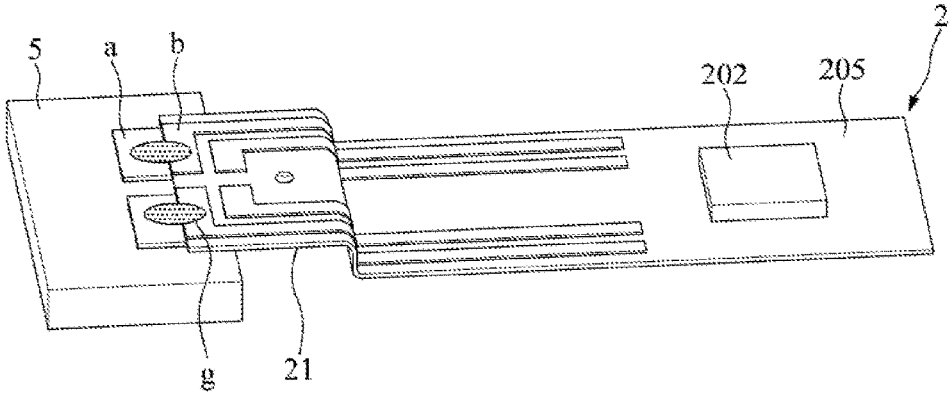
FIG. 2 is a perspective view schematically illustrating the soldering pad of the bendable circuit sheet of the LED light strip for soldering connection with the printed circuit board of the power supply of the LED tube lamp according to one embodiment of the present invention.

Referring to FIG. 1A, FIG. 1B, FIG. 1C, and FIG. 2, the LED light strip 2 has a bendable circuit sheet 205 mounted on the inner surface of the glass lamp tube 1. The bendable circuit sheet 205 electrically connects the LED light sources 202 with the power supply 5, and the length of the bendable circuit sheet 205 is larger than the length of the glass lamp tube 1. The bendable circuit sheet 205 has its ends extending beyond two ends of the glass lamp tube 1 to respectively form two freely extending end portions 21. As shown in FIG. 2, in which only one freely extending end portion 21 is illustrated, the freely extending end portion 21 is electrically connected to the power supply 5. Specifically, the power supply 5 has soldering pads "a" which are capable of being soldered with the soldering pads "b" of the freely extending end portion 21 by soldering material "g".

Figure 3:
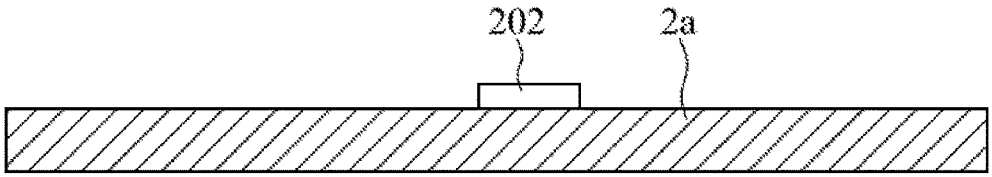
FIG. 3 is a plane cross-sectional view schematically illustrating a single-layered structure of the bendable circuit sheet of the LED light strip of the LED tube lamp according to an embodiment of the present invention.

Referring to FIG. 3, the bendable circuit sheet 205 is made of a metal layer structure 2*a*. The thickness range of the metal layer structure 2*a* may be 10 μm to 50 μm and the metal layer structure 2*a* may be a patterned wiring layer.

In some embodiments, the inner surface of the glass lamp tube 1 is coated with an anti-reflection layer with a thickness of one quarter of the wavelength range of light coming from the LED light sources 202. With the anti-reflection layer, more light from the LED light sources 202 can transmit through the glass lamp tube 1. In some embodiments, the refractive index of the anti-reflection layer is a square root of the refractive index of the glass lamp tube 1 with a tolerance of ±20%.

Figure 4:
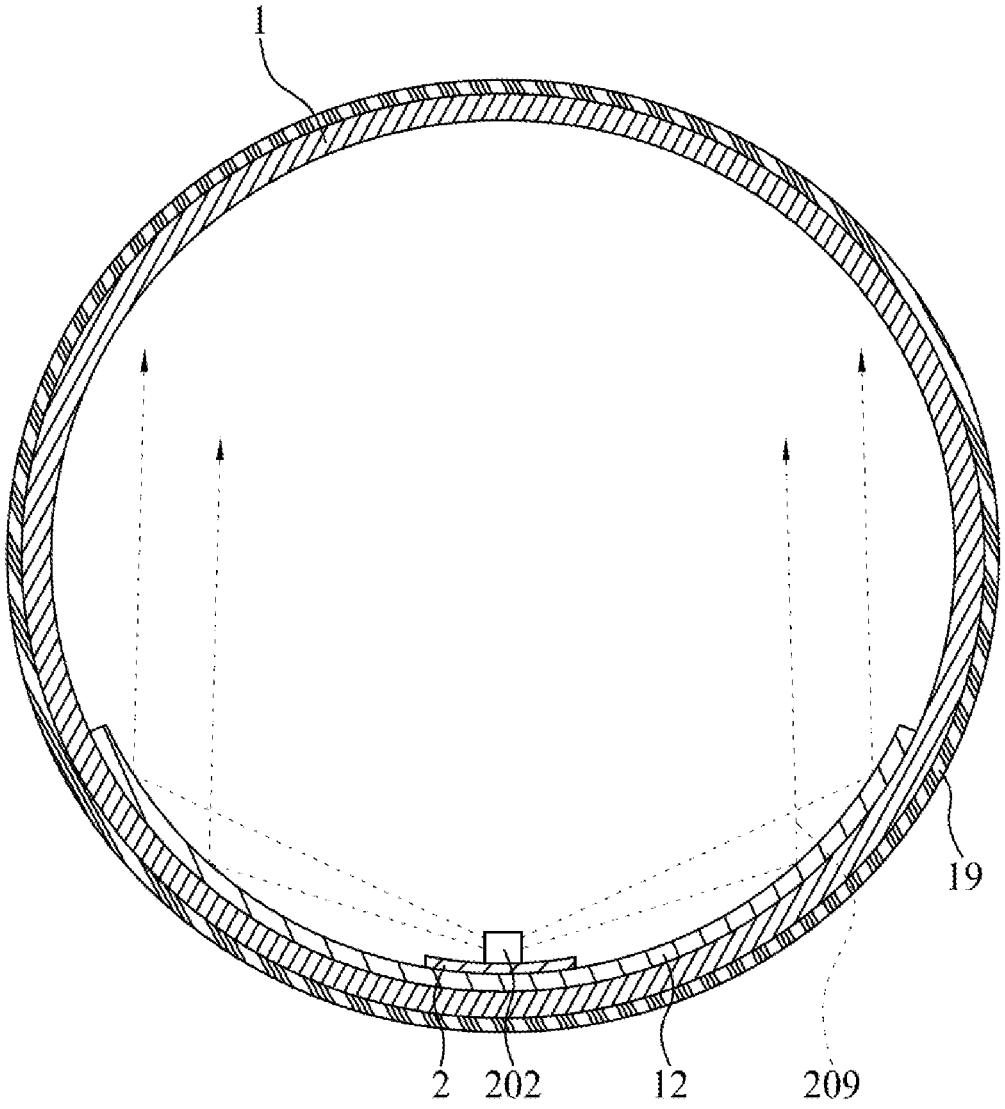
FIG. 4 is a plane cross-sectional view schematically illustrating inside structure of the glass lamp tube of the LED tube lamp according to one embodiment of the present invention, wherein two reflective films are respectively adjacent to two sides of the LED light strip along the circumferential direction of the glass lamp tube.

Referring to FIG. 4, in some embodiments, the glass lamp tube 1 may further include one or more reflective films 12 disposed on the inner surface of the glass lamp tube 1. The reflective film 12 can be positioned on two sides of the LED light strip 2. And in some embodiments, a ratio of a length of the reflective film 12 disposed on the inner surface of the glass lamp tube 1 extending along the circumferential direction of the glass lamp tube 1 to a circumferential length of the glass lamp tube 1 may be about 0.3 to 0.5, which means about 30% to 50% of the inner surface area may be covered by the reflective film(s) 12. The reflective film 12 may be made of PET with some reflective materials such as strontium phosphate or barium sulfate or any combination thereof, with a thickness between about 140 μm and about 350 μm or between about 150 μm and about 220 μm for a more preferred effect in some embodiments. In some embodiments, only the part of the inner surface which is not covered by the reflective film 12 is formed with the rough surface. As shown in FIG. 4, a part of light 209 from LED light sources 202 are reflected by two reflective films 12 such that the light 209 from the LED light sources 202 can be centralized to a determined direction.

Figure 5:
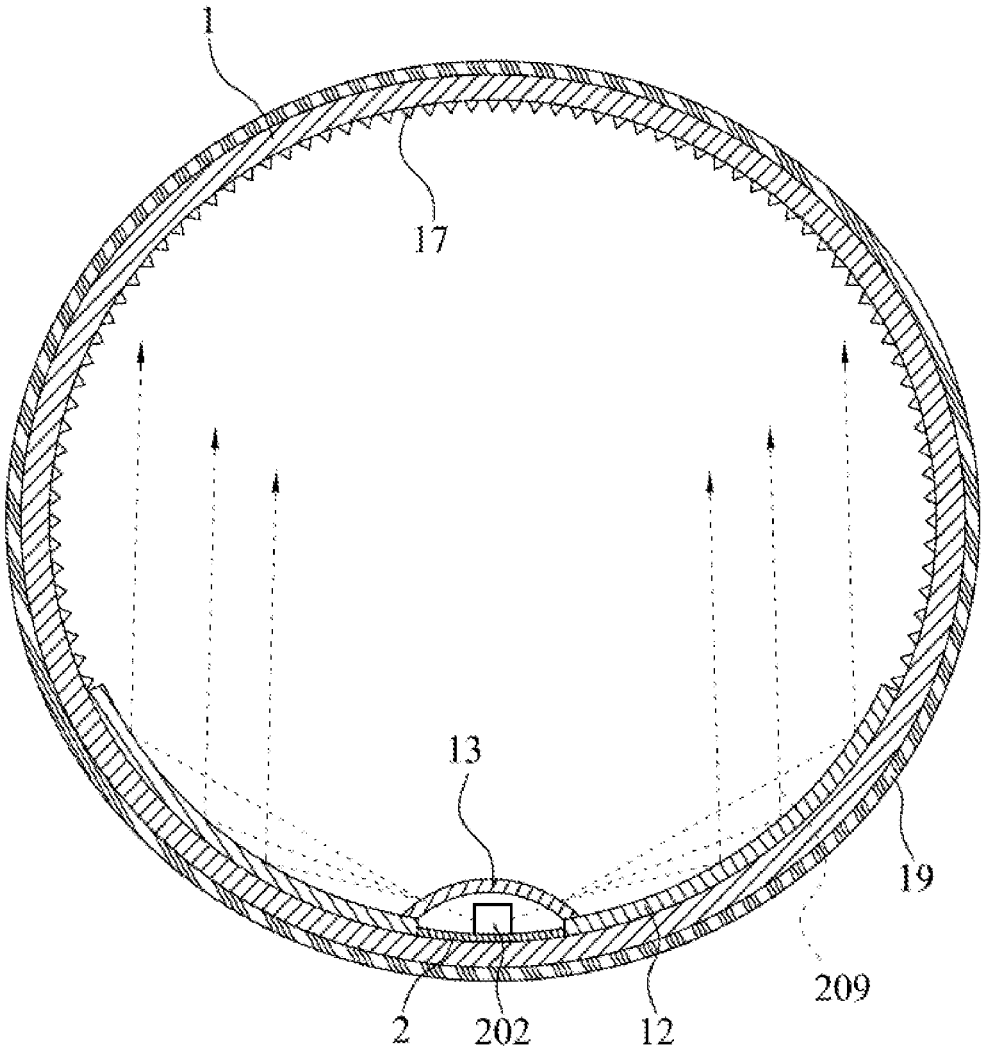
FIG. 5 is a plane cross-sectional view schematically illustrating inside structure of the glass lamp tube of the LED tube lamp according to one embodiment of the present invention, wherein two reflective films are respectively adjacent to two sides of the LED light strip along the circumferential direction of the glass lamp tube and a diffusion film is disposed covering the LED light sources.

Referring to FIG.5, in some embodiments, the glass lamp tube 1 may further include a diffusion film 13 so that the light emitted from the plurality of LED light sources 202 is transmitted through the diffusion film 13 and the glass lamp tube 1. The diffusion film 13 can be in form of various types, such as a coating onto the inner wall or outer wall of the glass lamp tube 1, or a diffusion coating layer (not shown) coated at the surface of each LED light sources 202, or a separate membrane covering the LED light sources 202.The glass lamp tube 1 also includes a heat shrink sleeve 19 and a plurality of inner roughness 17.

As shown in FIG. 5, the diffusion film 13 is in form of a sheet, and it covers but not in contact with the LED light sources 202. The diffusion film 13 in form of a sheet is usually called an optical diffusion sheet or board, usually a composite made of mixing diffusion particles into polystyrene (PS), polymethyl methacrylate (PMMA), polyethylene terephthalate (PET), and/or polycarbonate (PC), and/or any combination thereof. The light passing through such composite is diffused to expand in a wide range of space such as a light emitted from a plane source, and therefore makes the brightness of the LED tube lamp uniform.

The diffusion film 13 may be in form of an optical diffusion coating, which is composed of any one of calcium carbonate, halogen calcium phosphate and aluminum oxide, or any combination thereof. When the optical diffusion coating is made from a calcium carbonate with suitable solution, an excellent light diffusion effect and transmittance to exceed 90% can be obtained.

In some embodiments, the composition of the diffusion film 13 in form of the optical diffusion coating may include calcium carbonate, strontium phosphate, thickener, and a ceramic activated carbon. Specifically, such an optical diffusion coating on the inner circumferential surface of the glass lamp tube 1 has an average thickness ranging from about 20 to about 30 μm. A light transmittance of the diffusion film 13 using this optical diffusion coating may be about 90%. Generally speaking, the light transmittance of the diffusion film 13 may range from 85% to 96%. In addition, this diffusion film 13 can also provide electrical isolation for reducing risk of electric shock to a user upon breakage of the glass lamp tube 1. Furthermore, the diffusion film 13 provides an improved illumination distribution uniformity of the light outputted by the LED light sources 202 such that the light can illuminate the back of the light sources 202 and the side edges of the bendable circuit sheet 205 so as to avoid the formation of dark regions inside the glass lamp tube 1 and improve the illumination comfort. In another possible embodiment, the light transmittance of the diffusion film can be 92% to 94% while the thickness ranges from about 200 to about 300 μm.

In another embodiment, the optical diffusion coating can also be made of a mixture including calcium carbonate-based substance, some reflective substances like strontium phosphate or barium sulfate, a thickening agent, ceramic activated carbon, and deionized water. The mixture is coated on the inner circumferential surface of the glass lamp tube 1 and may have an average thickness ranging from about 20 to about 30 μm. In view of the diffusion phenomena in microscopic terms, light is reflected by particles. The particle size of the reflective substance such as strontium phosphate or barium sulfate will be much larger than the particle size of the calcium carbonate. Therefore, adding a small amount of reflective substance in the optical diffusion coating can effectively increase the diffusion effect of light.

Halogen calcium phosphate or aluminum oxide can also serve as the main material for forming the diffusion film 13. The particle size of the calcium carbonate may be about 2 to 4 μm, while the particle size of the halogen calcium phosphate and aluminum oxide may be about 4 to 6 μm and 1 to 2 μm, respectively. When the light transmittance is required to be 85% to 92%, the required average thickness for the optical diffusion coating mainly having the calcium carbonate may be about 20 to about 30 μm, while the required average thickness for the optical diffusion coating mainly having the halogen calcium phosphate may be about 25 to about 35 μm, the required average thickness for the optical diffusion coating mainly having the aluminum oxide may be about 10 to about 15 μm. However, when the required light transmittance is up to 92% and even higher, the optical diffusion coating mainly having the calcium carbonate, the halogen calcium phosphate, or the aluminum oxide must be thinner.

The main material and the corresponding thickness of the optical diffusion coating can be decided according to the place for which the glass lamp tube 1 is used and the light transmittance required. It is to be noted that the higher the light transmittance of the diffusion film 13 is required, the more apparent the grainy visual of the light sources is.

In some embodiments the inner peripheral surface or the outer circumferential surface of the glass lamp tube 1 may be further covered or coated with an adhesive film (not shown) to isolate the inside from the outside of the glass lamp tube 1 when the glass lamp tube 1 is broken. In this embodiment, the adhesive film is coated on the inner peripheral surface of the glass lamp tube 1. The material for the coated adhesive film includes methyl vinyl silicone oil, hydro silicone oil, xylene, and calcium carbonate, wherein xylene is used as an auxiliary material. The xylene will be volatilized and removed when the coated adhesive film on the inner surface of the glass lamp tube 1 solidifies or hardens. The xylene is mainly used to adjust the capability of adhesion and therefore to control the thickness of the coated adhesive film.

In some embodiments, the thickness of the coated adhesive film may be between about 100 and about 140 micrometers (μm). The adhesive film having a thickness being less than 100 micrometers may not have sufficient shatterproof capability for the glass lamp tube 1, and the glass lamp tube 1 is thus prone to crack or shatter. The adhesive film having a thickness being larger than 140 micrometers may reduce the light transmittance and also increases material cost. The thickness of the coated adhesive film may be between about 10 and about 800 micrometers (μm) when the shatterproof capability and the light transmittance are not strictly demanded. With the adhesive film, the broken pieces are adhered to the adhesive film when the glass lamp tube 1 is broken. Therefore, the glass lamp tube 1 would not be penetrated to form a through hole connecting the inside and outside of the glass lamp tube 1 and thus prevents a user from touching any charged object inside the glass lamp tube 1 to avoid electrical shock.

Referring to FIG. 1A, FIG. 1B, and FIG. 1C, an LED tube lamp in accordance with a second embodiment of the present invention includes a glass lamp tube 1, an LED light strip 2, and one end cap 3 disposed at one end of the glass lamp tube 1. At least a part of the inner surface of the glass lamp tube 1 is formed with a rough surface and the roughness of the inner surface is higher than that of the outer surface. In this embodiment, the glass lamp tube 1 may have only one inlet located at one end while the other end is entirely sealed or integrally formed with tube body. The LED light strip 2 is disposed inside the glass lamp tube 1 with a plurality of LED light sources 202 mounted on the LED light strip 2. The end cap 3 is disposed at the end of the glass lamp tube 1 where the inlet located, and the power supply 5 is provided inside the end cap 3. In another embodiment, as shown in FIG. 1B, the glass lamp tube 1 may have two inlets, two end caps 3 respectively disposed at two ends of the glass lamp tube 1, and one power supply 5 provided inside one of the end caps 3. In another embodiment, as shown in FIG. 1C, the glass lamp tube 1 may have two inlets, two end caps 3 respectively disposed at two ends of the glass lamp tube 1, and two power supplies 5 respectively provided inside the two end caps 3.

The glass lamp tube 1 is covered by a heat shrink sleeve 19. The heat shrink sleeve 19 is substantially transparent with respect to the wavelength of light from the LED light sources 202 and may be made of PFA (perfluoroalkoxy) or PTFE (poly tetra fluoro ethylene). At least a part of the inner surface of the glass lamp tube 1 is formed with a rough surface and the roughness of the inner surface is higher than that of the outer surface, such that the light from the LED light sources 202 can be uniformly spread when transmitting through the glass lamp tube 1.

The glass lamp tube 1 and the end cap 3 are secured by a highly thermal conductive silicone gel disposed between an inner surface of the end cap 3 and outer surfaces of the glass lamp tube 1. In some embodiments, the highly thermal conductive silicone gel has a thermal conductivity not less than 0.7 w/m·k. In some embodiments, the thermal conductivity of the highly thermal conductive silicone gel is not less than 2 w/m·k. In some embodiments, the highly thermal conducive silicone gel is of high viscosity, and the end cap 3 and the end of the glass lamp tube 1 could be secured by using the highly thermal conductive silicone gel and therefore qualified in a torque test of 1.5 to 5 newton-meters (Nt-m) and/or in a bending test of 5 to 10 newton-meters (Nt-m). The highly thermal conductive silicone gel has excellent weatherability and can prevent moisture from entering inside of the glass lamp tube 1, which improves the durability and reliability of the LED tube lamp.

Referring to FIG. 1A, FIG. 1B, FIG. 1C, and FIG. 2, the LED light strip 2 has a bendable circuit sheet 205 mounted on the inner surface of the glass lamp tube 1. The bendable circuit sheet 205 electrically connects the LED light sources 202 with the power supply 5, and the length of the bendable circuit sheet 205 is larger than the length of the glass lamp tube 1. In some embodiments, the bendable circuit sheet 205 has its ends extending beyond two ends of the glass lamp tube 1 to respectively form two freely extending end portions 21. As shown in E2, in which only one freely extending end portion 21 is illustrated, the freely extending end portion 21 is electrically connected to the power supply 5. Specifically, the power supply 5 has soldering pads "a" which are capable of being soldered with the soldering pads "b" of the freely extending end portion 21 by soldering material "g".

In the previously-described first embodiment, the bendable circuit sheet 205 is made of a metal layer structure 2*a*, and the thickness of the heat shrink sleeve 19 is between 20 μm and 200 μm. However, in the second embodiment, the structure of the bendable circuit sheet 205 and the thickness of the heat shrink sleeve 19 are not limited.

In the second embodiment, the inner surface of the glass lamp tube 1 may be coated with an anti-reflection layer with a thickness of one quarter of the wavelength range of light coming from the LED light sources 202. With the anti-reflection layer, more light from the LED light sources 202 can transmit through the glass lamp tube 1.

Referring to FIG. 4, in the second embodiment, the glass lamp tube 1 may further include one or more reflective films 12 disposed on the inner surface of the glass lamp tube 1. In some embodiments, only the part of the inner surface which is not covered by the reflective film 12 is formed with the rough surface. As shown in FIG. 4, a part of light 209 from LED light sources 202 are reflected by two reflective films 12 such that the light 209 from the LED light sources 202 can be centralized to a determined direction.

Referring to FIG. 5, in the second embodiment, the glass lamp tube 1 may further include a diffusion film 13 so that the light emitted from the plurality of LED light sources 202 is transmitted through the diffusion film 13 and the glass lamp tube 1. The diffusion film 13 can be in form of various types as described in the first embodiment. The glass lamp tube 1 also includes a heat shrink sleeve 19 and a plurality of inner roughness 17.

In the second embodiment, the inner peripheral surface or the outer circumferential surface of the glass lamp tube 1 may be further covered or coated with an adhesive film (not shown) to isolate the inside from the outside of the glass lamp tube 1 when the glass lamp tube 1 is broken. The adhesive film may be coated on the inner peripheral surface of the glass lamp tube 1. With the adhesive film, the broken pieces are adhered to the adhesive film when the glass lamp tube 1 is broken. Therefore, the glass lamp tube 1 would not be penetrated to form a through hole connecting the inside and outside of the glass lamp tube 1 and thus prevents a user from touching any charged object inside the glass lamp tube 1 to avoid electrical shock.

Referring to FIG. 1A, FIG. 1B, and FIG. 1C, an LED tube lamp in accordance with a third embodiment of the present invention includes a glass lamp tube 1, an LED light strip 2 disposed inside the glass lamp tube 1, and one end cap 3 disposed at one end of the glass lamp tube 1. In this embodiment, as shown in FIG.1A, the glass lamp tube 1 may have only one inlet located at one end while the other end is entirely sealed or integrally formed with tube body. The LED light strip 2 is disposed inside the glass lamp tube 1 with a plurality of LED light sources 202 mounted on the LED light strip 2. The end cap 3 is disposed at the end of the glass lamp tube 1 where the inlet located, and the power supply 5 is provided inside the end cap 3. In another embodiment, as shown in FIG.1 B, the glass lamp tube 1 may have two inlets, two end caps 3 respectively disposed at two ends of the glass lamp tube 1, and one power supply 5 provided inside one of the end caps 3. In another embodiment, as shown in FIG. 1C, the glass lamp tube 1 may have two inlets, two end caps 3 respectively disposed at two ends of the glass lamp tube 1, and two power supplies 5 respectively provided inside the two end caps 3.

The glass lamp tube 1 is covered by a heat shrink sleeve 19. The heat shrink sleeve 19 is substantially transparent with respect to the wavelength of light from the LED light sources 202 and may be made of PFA (perfluoroalkoxy) or PTFE (poly tetra fluoro ethylene). At least a part of the inner surface of the glass lamp tube 1 is formed with a rough surface with a roughness from 0.1 μm to 40 μm. The roughness of the inner surface is higher than that of the outer surface, such that the light from the LED light sources 202 can be uniformly spread when transmitting through the glass lamp tube 1.

The end cap 3 is disposed at one end of the glass lamp tube 1 and the power supply 5 is provided inside the end cap 3. The glass lamp tube 1 and the end cap 3 are secured by a highly thermal conductive silicone gel disposed between an inner surface of the end cap 3 and outer surfaces of the glass lamp tube 1. In some embodiments, the highly thermal conductive silicone gel has a thermal conductivity not less than 0.7 w/m·k. In some embodiments, the thermal conductivity of the highly thermal conductive silicone gel is not less than 2 w/m·k. In some embodiments, the highly thermal conducive silicone gel is of high viscosity, and the end cap 3 and the end of the glass lamp tube 1 could be secured by using the highly thermal conductive silicone gel and therefore qualified in a torque test of 1.5 to 5 newton-meters (Nt-m) and/or in a bending test of 5 to 10 newton-meters (Nt-m). The highly thermal conductive silicone gel has excellent weatherability and can prevent moisture from entering inside of the glass lamp tube 1, which improves the durability and reliability of the LED tube lamp.

Referring to FIG. 1A, FIG. 1B, FIG. 1C and FIG. 2, the LED light strip 2 has a bendable circuit sheet 205 mounted on the inner surface of the glass lamp tube 1. The bendable circuit sheet 205 electrically connects the LED light sources 202 with the power supply 5, and the length of the bendable circuit sheet 205 is larger than the length of the glass lamp tube 1. The bendable circuit sheet 205 has its ends extending beyond two ends of the glass lamp tube 1 to respectively form two freely extending end portions 21. As shown in FIG. 2, in which only one freely extending end portion 21 is illustrated, the freely extending end portion 21 is electrically connected to the power supply 5. Specifically, the power supply 5 has soldering pads "a" which are capable of being soldered with the soldering pads "b" of the freely extending end portion 21 by soldering material "g".

Referring to FIG. 3, in the third embodiment, the bendable circuit sheet 205 is made of a metal layer structure 2*a*. The thickness range of the metal layer structure 2*a* may be 10 μm to 50 μm and the metal layer structure 2*a* may be a patterned wiring layer.

In the third embodiment, the inner surface of the glass lamp tube 1 is coated with an anti-reflection layer with a thickness of one quarter of the wavelength range of light coming from the LED light sources 202. With the anti-reflection layer, more light from the LED light sources 202 can transmit through the glass lamp tube 1.

Referring to FIG. 4, in the third embodiment, the glass lamp tube 1 may further include one or more reflective films 12 disposed on the inner surface of the glass lamp tube 1. In some embodiments, only the part of the inner surface which is not covered by the reflective film 12 is formed with the rough surface. As shown in FIG. 4, a part of light 209 from LED light sources 202 are reflected by two reflective films 12 such that the light 209 from the LED light sources 202 can be centralized to a determined direction.

Referring to FIG. 5, in the third embodiment, the glass lamp tube 1 may further include a diffusion film 13 so that the light emitted from the plurality of LED light sources 202 is transmitted through the diffusion film 13 and the glass lamp tube 1. The diffusion film 13 can be in form of various types as described in the first embodiment. The glass lamp tube 1 also includes a heat shrink sleeve 19 and a plurality of inner roughness 17.

In the third embodiment, the inner peripheral surface or the outer circumferential surface of the glass lamp tube 1 may be further covered or coated with an adhesive film (not shown) to isolate the inside from the outside of the glass lamp tube 1 when the glass lamp tube 1 is broken. The adhesive film may be coated on the inner peripheral surface of the glass lamp tube 1. With the adhesive film, the broken pieces are adhered to the adhesive film when the glass lamp tube 1 is broken. Therefore, the glass lamp tube 1 would not be penetrated to form a through hole connecting the inside and outside of the glass lamp tube 1 and thus prevents a user from touching any charged object inside the glass lamp tube 1 to avoid electrical shock.

The above-mentioned features of the present invention can be accomplished in any combination to improve the LED tube lamp, and the above embodiments are described by way of example only. The present invention is not herein limited, and many variations are possible without departing from the spirit of the present invention and the scope as defined in the appended claims.

What is claimed is:

1. An LED tube lamp, comprising:

a glass lamp tube covered by a heat shrink sleeve with the thickness of the heat shrink sleeve being 20 μm to 200 μm, wherein at least a part of an inner surface of the glass lamp tube is formed with a rough surface and the roughness of the inner surface is higher than that of an outer surface of the glass lamp tube;

two end caps, each having at least one pin, and each coupled to a respective end of the glass lamp tube;

a power supply disposed in one of the end caps, or disposed in a separated manner in the two end caps; and an LED light strip disposed inside the glass lamp tube with a plurality of LED light sources mounted on the LED light strip;

wherein the LED light strip has a bendable circuit sheet or a flexible circuit board which is made of a metal layer structure and mounted on the inner surface of the glass lamp tube to electrically connect the LED light sources with the power supply, the length of the bendable circuit sheet or flexible circuit board is larger than the length of the glass lamp tube, and the glass lamp tube and the end cap are secured by a highly thermal conductive silicone gel.

2. The LED tube lamp of claim 1, wherein the thermal conductivity of the highly thermal conductive silicone gel is not less than 0.7 w/m·k.

3. The LED tube lamp of claim 1, wherein the thickness of the metal layer structure ranges from 10 μm to 50 μm.

4. The LED tube lamp of claim 3, wherein the metal layer structure is a patterned wiring layer.

5. The LED tube lamp of claim 1, wherein the roughness of the inner surface ranges from 0.1 to 40 μm.

6. The LED tube lamp of claim 1, wherein the glass lamp tube is coated with an anti-reflection layer with a thickness of one quarter of the wavelength range of light coming from the LED light sources.

7. The LED tube lamp of claim 6, wherein the refractive index of the anti-reflection layer is a square root of the refractive index of the glass lamp tube with a tolerance of ±20%.

8. The LED tube lamp of claim 1, wherein the bendable circuit sheet or flexible circuit board has its ends extending beyond two ends of the glass lamp tube to respectively form two freely extending end portions.

9. The LED tube lamp of claim 1, further comprising one or more reflective films to reflect light from the plurality of LED light sources.

10. The LED tube lamp of claim 1, wherein the glass lamp tube comprises a diffusion film so that the light emitted from the plurality of LED light sources is transmitted through the diffusion film and the glass lamp tube.

11. The LED tube lamp of claim 1, wherein the glass lamp tube is covered with an adhesive film.

12. An LED tube lamp, comprising:

a glass lamp tube, wherein at least a part of an inner surface of the glass lamp tube is formed with a rough surface and the roughness of the inner surface is higher than that of the outer surface;

two end caps, each having at least one pin, and each coupled to a respective end of the glass lamp tube;

a power supply disposed in one of the end caps, or disposed in a separated manner in the two end caps; and an LED light strip disposed inside the glass lamp tube with a plurality of LED light sources mounted on the LED light strip;

wherein the LED light strip has a bendable circuit sheet or a flexible circuit board mounted on an inner surface of the glass lamp tube to electrically connect the LED light sources with the power supply, the length of the bendable circuit sheet or flexible circuit board is larger than the length of the glass lamp tube, and the glass lamp tube and the end cap are secured by a highly thermal conductive silicone gel.

13. The LED tube lamp of claim 12, wherein the thermal conductivity of the highly thermal conductive silicone gel is not less than 0.7 w/m·k.

14. The LED tube lamp of claim 12, wherein the thickness of the metal layer structure ranges from 10 μm to 50 μm.

15. The LED tube lamp of claim 14, wherein the metal layer structure is a patterned wiring layer.

16. The LED tube lamp of claim 12, further comprising one or more reflective films to reflect light from the plurality of LED light sources.

17. An LED tube lamp, comprising:

a glass lamp tube covered by a heat shrink sleeve;

two end caps, each having at least one pin, and each coupled to a respective end of the glass lamp tube;

a power supply disposed in one of the end caps, or disposed in a separated manner in the two end caps; and an LED light strip disposed inside the glass lamp tube with a plurality of LED light sources mounted on the LED light strip;

wherein the LED light strip has a bendable circuit sheet or a flexible circuit board which is made of a metal layer structure and mounted on an inner surface of the glass lamp tube to electrically connect the LED light sources with the power supply, the length of the bendable circuit sheet or flexible circuit board is larger than the length of the glass lamp tube, and the glass lamp tube and the end cap are secured by a highly thermal conductive silicone gel.

18. The LED tube lamp of claim 17, further comprising one or more reflective films to reflect light from the plurality of LED light sources.

19. The LED tube lamp of claim 17, wherein the thickness of the metal layer structure ranges from 10 μm to 50 μm.

20. The LED tube lamp of claim 19, wherein the metal layer structure is a patterned wiring layer.

* * * * *